US007661992B1

(12) United States Patent
Ma

(10) Patent No.: US 7,661,992 B1
(45) Date of Patent: Feb. 16, 2010

(54) SAFE POWER PLUGGING MECHANISM

(75) Inventor: Hing Wai Michael Ma, Kowloon (CN)

(73) Assignee: Cord-It Limited, Kowloon, Hong Kong (CN)

( * ) Notice: Subject to any disclaimer, the term of this patent is extended or adjusted under 35 U.S.C. 154(b) by 0 days.

(21) Appl. No.: 12/316,788

(22) Filed: Dec. 16, 2008

(51) Int. Cl.
*H01R 27/02* (2006.01)

(52) U.S. Cl. ..... 439/640

(58) Field of Classification Search ..... 439/31, 439/131, 165, 172, 640
See application file for complete search history.

(56) References Cited

U.S. PATENT DOCUMENTS 453,633 A * 6/1891 Furlong ..... 218/117
2,254,347 A * 9/1941 Blakesley ..... 200/506
5,401,178 A * 3/1995 Liu ..... 439/131
6,062,880 A * 5/2000 Skuza ..... 439/131
6,126,460 A * 10/2000 Wu ..... 439/131
6,275,009 B1 * 8/2001 Sakakibara et al. ..... 320/134
6,638,113 B2 * 10/2003 Kajiwara et al. ..... 439/651
7,549,877 B1 * 6/2009 Vista et al. ..... 439/172

* cited by examiner

*Primary Examiner*—Renee Luebke
*Assistant Examiner*—Larisa Tsukerman
(74) *Attorney, Agent, or Firm*—Alix, Yale & Ristas, LLP

(57) ABSTRACT

A safe power plugging mechanism is configured on a power base with a pivot joint, wherein a male plug with conducting plates at its inside is configured on the pivot joint and is electrically connected with the pivot joint. A half-tile-shaped insulating tile configured outside the pivot joint axis is integral with the enclosure of the male plug, and partly encloses the pivot joint axis. A power connection plate is configured inside the power base to electrically connect the conducting plates of the male plug when the male plug is turned to a specific angle. The safe plugging mechanism also includes a female plug, which is configured at its inside with two conducting poles fitting the conducting plates of the male plug. The safe power plugging mechanism adopts a method of electric connection through a pivot joint axis which maintains connection at a specific angle and insulation at other angles.

11 Claims, 9 Drawing Sheets

SAFE POWER PLUGGING MECHANISM

BACKGROUND OF INVENTION

1. Field of the Invention

The present invention relates generally to a plugging mechanism for electric power, and more particularly to a plugging mechanism which ensures safe connection to electric power, and which can be configured on mobile sockets, wall-mounted sockets, etc., and is particularly suitable for smart plugs commonly employed as power plugs for notebook computers.

2. Description of Related Art

Along with rapid development of technologies, especially with improvement of safety standards in developed countries, safety of power plugging mechanisms nowadays is more and more emphasized.

In current power plugging mechanisms, usually a plug meeting respective national standards is inserted into a socket, the conducting plates of which are hidden inside the socket, while the conducting poles of the plug are exteriorly exposed.

In addition, in prior-art power plugging mechanisms, there is also a type of smart plug mechanism, in which a male plug is connected to electric power. There are conducting plates configured inside the insulating enclosure of the male plug. The connecting terminal is formed as an 8-shaped plugging edge; and on the female plug side, an 8-shaped plugging notch fitting the insulating enclosure is correspondingly configured to enclose the exposed conducting poles inside the plugging notch. In this way, the smart plug mechanism is relatively safer than ordinary plug-socket power plugging mechanisms. Currently, such smart plugs are commonly seen in the power connection of notebook computers.

However, in all prior-art power plugging mechanisms, including smart plugs, the plugging parts often fall apart under accidental impacts such as stumbling on the cord or children playing, causing separation between the plug and the socket, or between the male and female plugs. Particularly in a wet environment or when the plugging operator's hands are wet, there is still danger of electric shock since the inside of the socket or male plug is live.

Hence, the prior-art mechanisms require some improvement and development. A type of power plugging mechanism that has improved safety is provided.

SUMMARY

A type of safe power plugging mechanism ensures power connection inside the socket upon plugging and disconnection when there is no plug inserted into the socket. In this way, the safety property is enhanced.

A safe power plugging mechanism on a power base includes a male plug configured on the power base. The enclosure of the male plug is made of insulating material, and is configured inside with conducting plates which are electrically connected with the conductive pivot joint axis in the male plug. The outside of the pivot joint axis is configured with a half-tile-shaped insulating tile, which is integral with the enclosure of the male plug, and which partly encloses the pivot joint axis. A power connection plate is configured inside the power base to connect with an outer power source. When the male plug is turned to a specific angle, the power connection plate contacts the pivot joint axis and electrically connects the conducting plates of the male plug. The safe plugging mechanism also includes a female plug, the enclosure of which is made of insulating material. The female plug is configured with two conducting poles at the inside which fit the conducting plates of the male plug.

The safe plugging mechanism may have a receptacle configured on the power base to house the male plug. The two sides of the receptacle are configured as supporting walls to fit the pivot joint axis. The side wall of the receptacle parallel to the pivot joint axis is configured with a raised locking part, and at the corresponding position on the enclosure of the male plug, a concave locking part is configured to fit the raised locking part and lock the male plug at a specific position, so that the insulating tile is maintained between the power connecting plate and the pivot joint axis when the female plug is not connected with the male plug.

The safe plugging mechanism may employ a raised locking part which is configured on the side wall of the receptacle in a flexible manner and is configured with a protruding part, so that when the female plug is inserted, the enclosure of the female plug unlocks the fitting between the raised locking part and the concave locking part.

The safe plugging mechanism may employ two side walls of the receptacle which are configured with blocking walls on the front extensions, and at the corresponding position on the enclosure of the female plug, a blocking nose is configured, so as to maintain electrical connection between the female plug and the male plug when the power connecting plate contacts the pivot joint axis.

The safe plugging mechanism may employ a lower side of the protruding part configured as a stage, and on the lower side of the concave locking part, at least two sockets are configured to fit the stage with a click when turning the male plug.

The safe plugging mechanism may employ the male plug and the female plug which are smart-plug structures.

The safe plugging mechanism may employ the receptacle which is configured on a socket baseboard.

As the safe power plugging mechanism adopts a method of electric connection through a pivot joint axis which maintains connection at a specific angle and insulation at other angles, the refined structure achieves higher safety through the safe plugging mechanism at the inside.

DETAILED DESCRIPTION OF THE INVENTION

Following are detailed descriptions of various preferred embodiments in combination with the attached drawings.

Figure 1A:
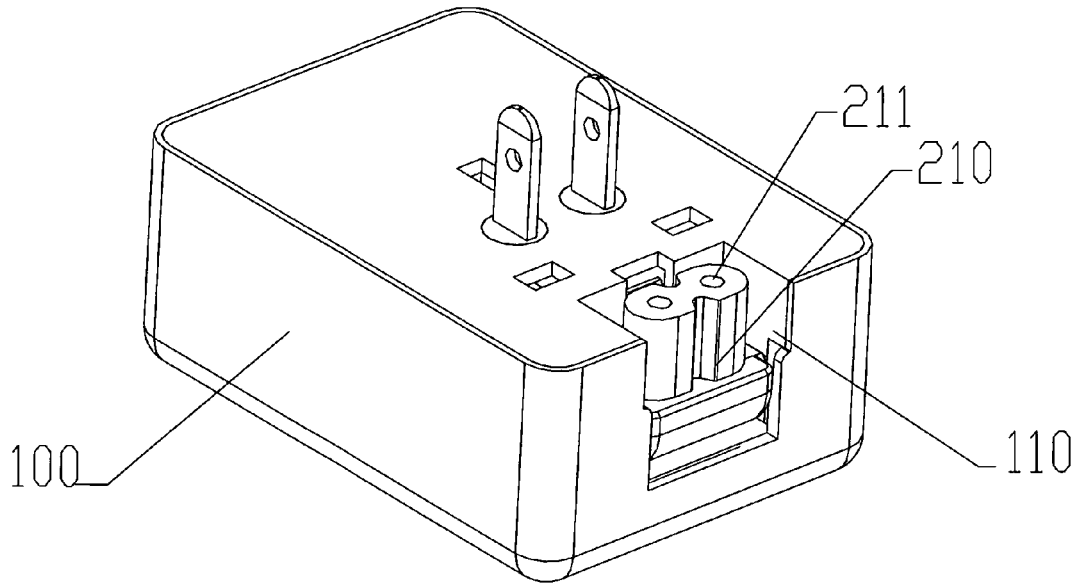
FIG. 1*a* is a three-dimensional drawing of a safe power plugging mechanism when not plugged.
Figure 1B:
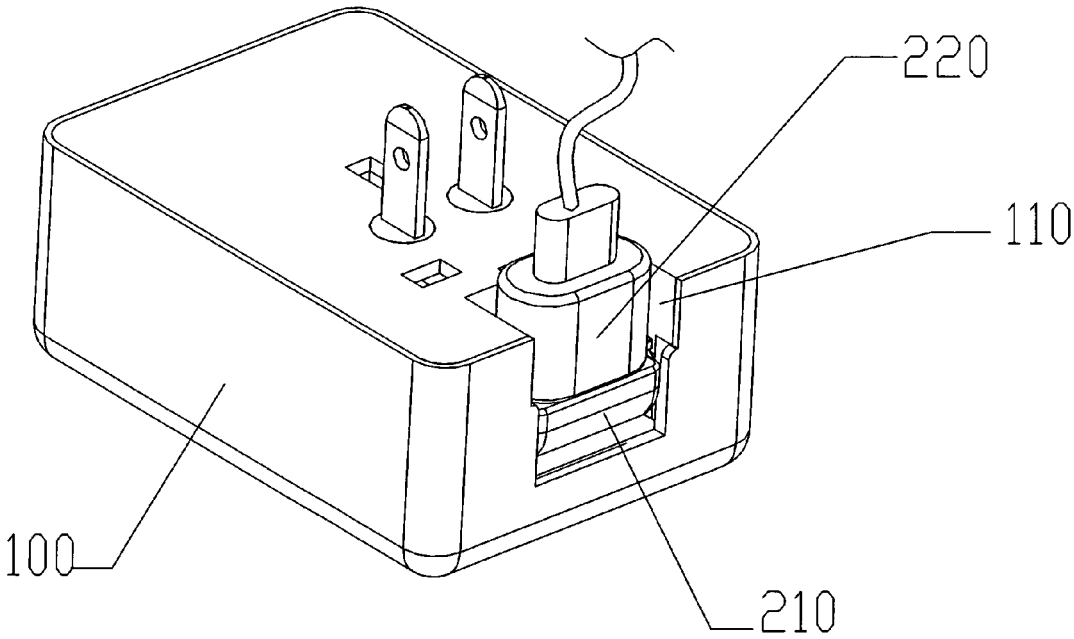
FIG. 1*b* is a three-dimensional drawing of the safe power plugging mechanism when plugged.
Figure 1C:
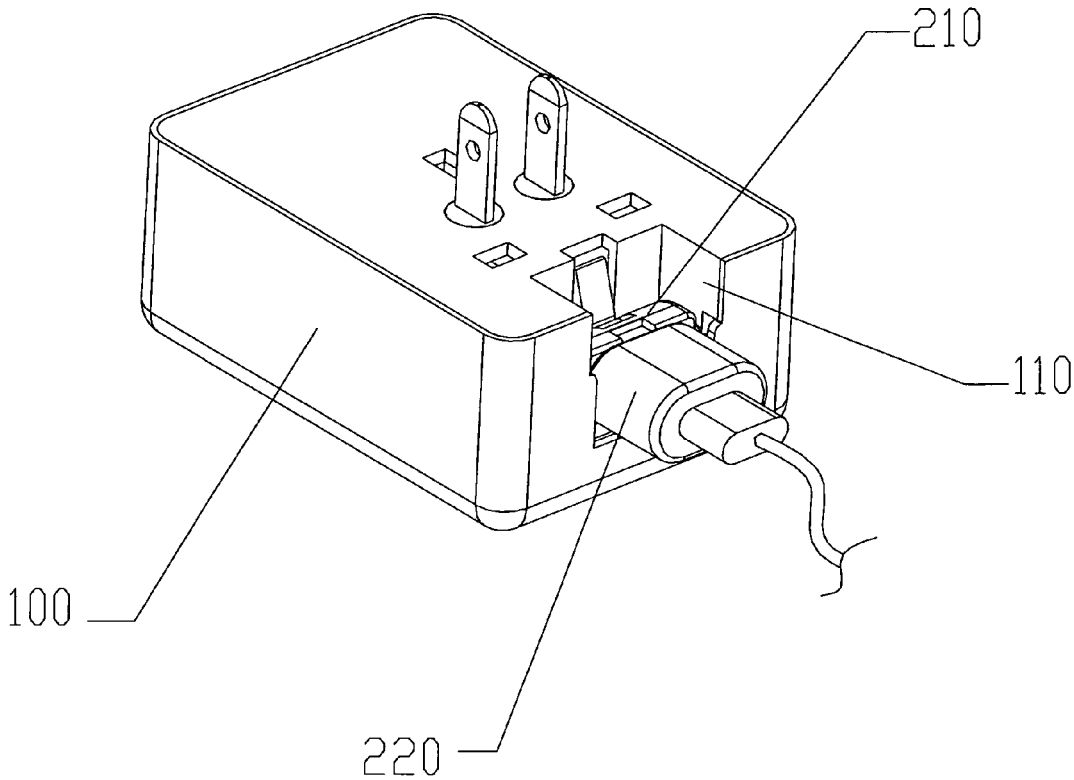
FIG. 1*c* is a three-dimensional drawing of the safe power plugging mechanism when plugged and working.
Figure 2A:
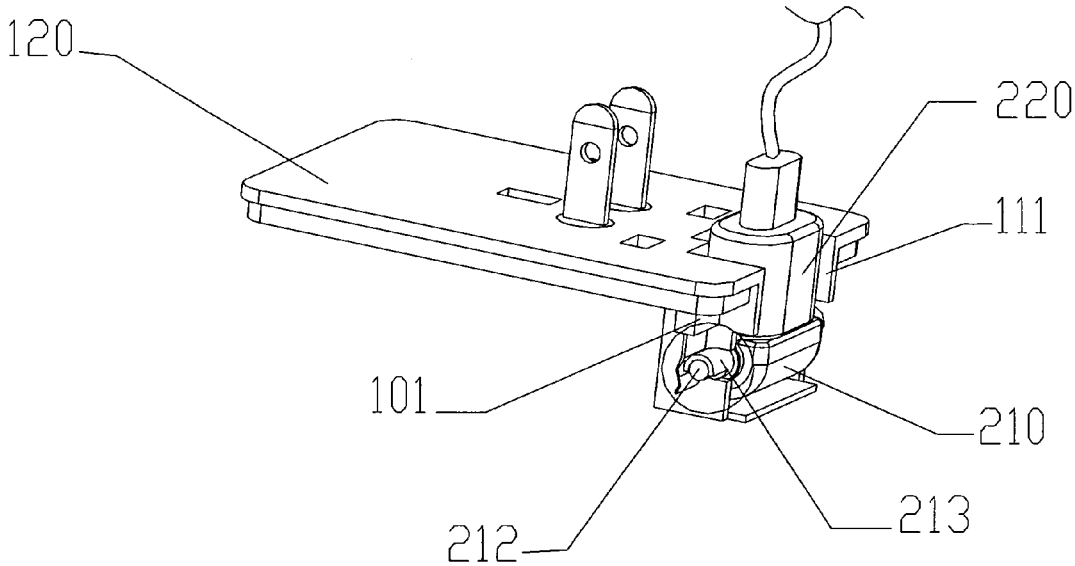
FIG. 2*a* is a drawing of the inner structure of the safe power plugging mechanism at the state shown in FIG. 1*b;*
Figure 2B:
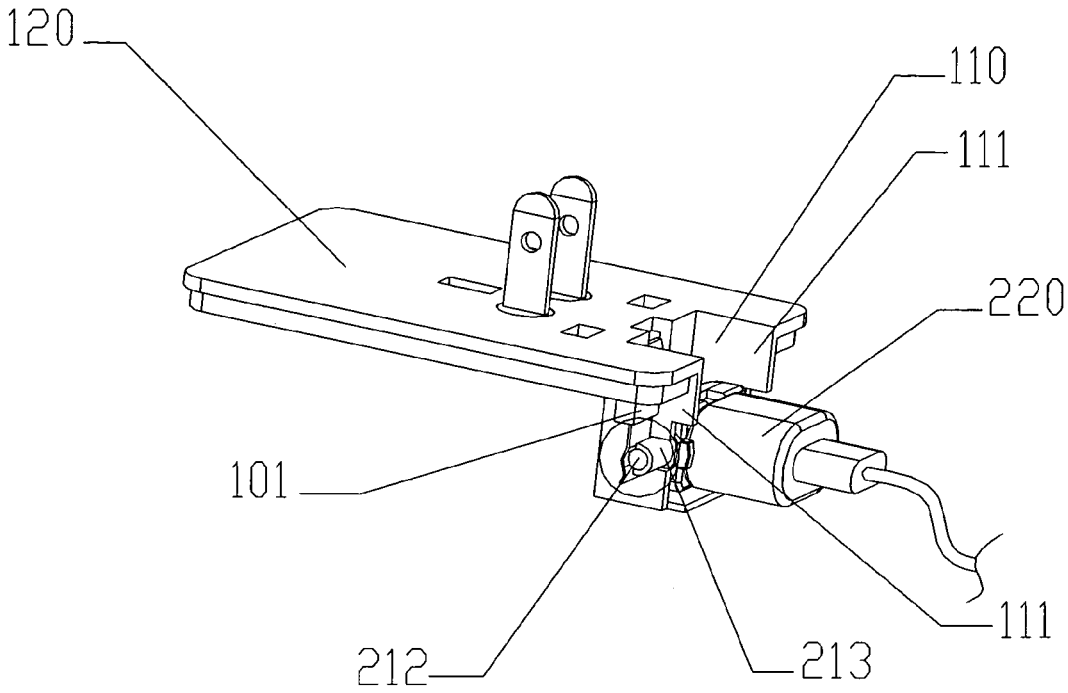
FIG. 2*b* is a drawing of the inner structure of the safe power plugging mechanism at the state shown in FIG. 1*c;*
Figure 4:
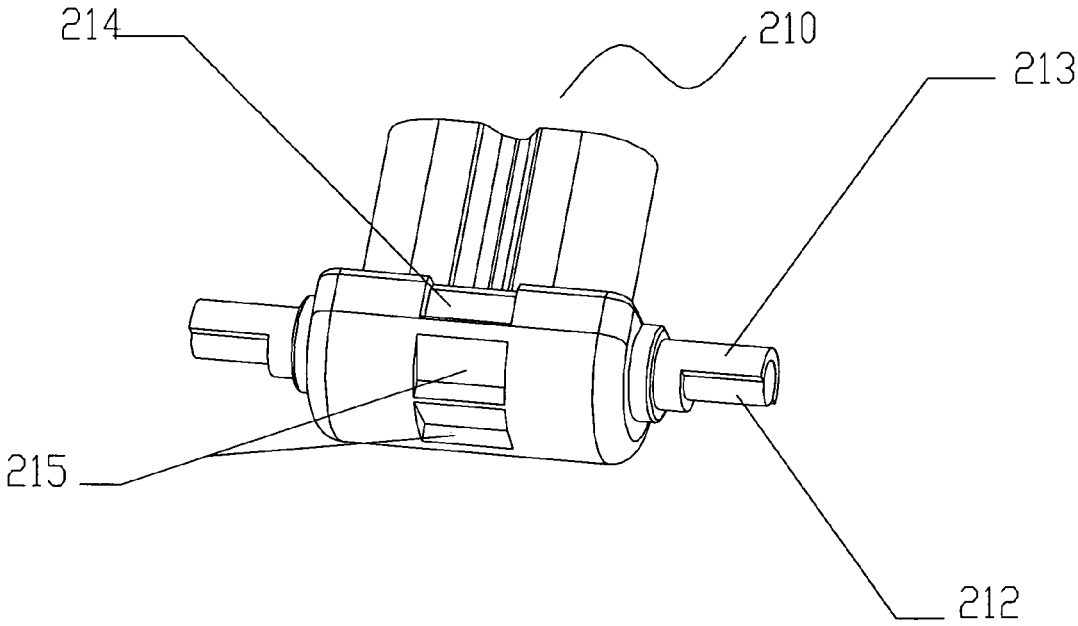
FIG. 4 is a structural drawing of the male plug of the safe power plugging mechanism.

A type of a safe power plugging mechanism is shown in FIG. 1*a*, FIG. 1*b* and FIG. 1*c*. It is configured with a male plug 210, as shown in FIG. 4, connecting electric power through a pivot joint axis 212. The male plug 210 is configured inside the receptacle 110 on the power base 100. The pivot joint axis 212 is fitted on the two supporting walls 111 of the receptacle 110, as shown in FIG. 2*a* and FIG. 2*b*.

The enclosure of the male plug 210 is made of insulating material, and is configured with two conducting plates 211 on the inner side of the plugging head, as shown in FIG. 1*a*. The pivot joint axis 212 is made of conductive material. As shown in FIG. 2*a*, a power connecting plate 101 is configured inside the power base 100 or on the socket baseboard 120 of the power base 100, and is connected to an external power source through the conductive lines in the power base, i.e., normally the power connecting plate 101 is power-connected.

Figure 5:
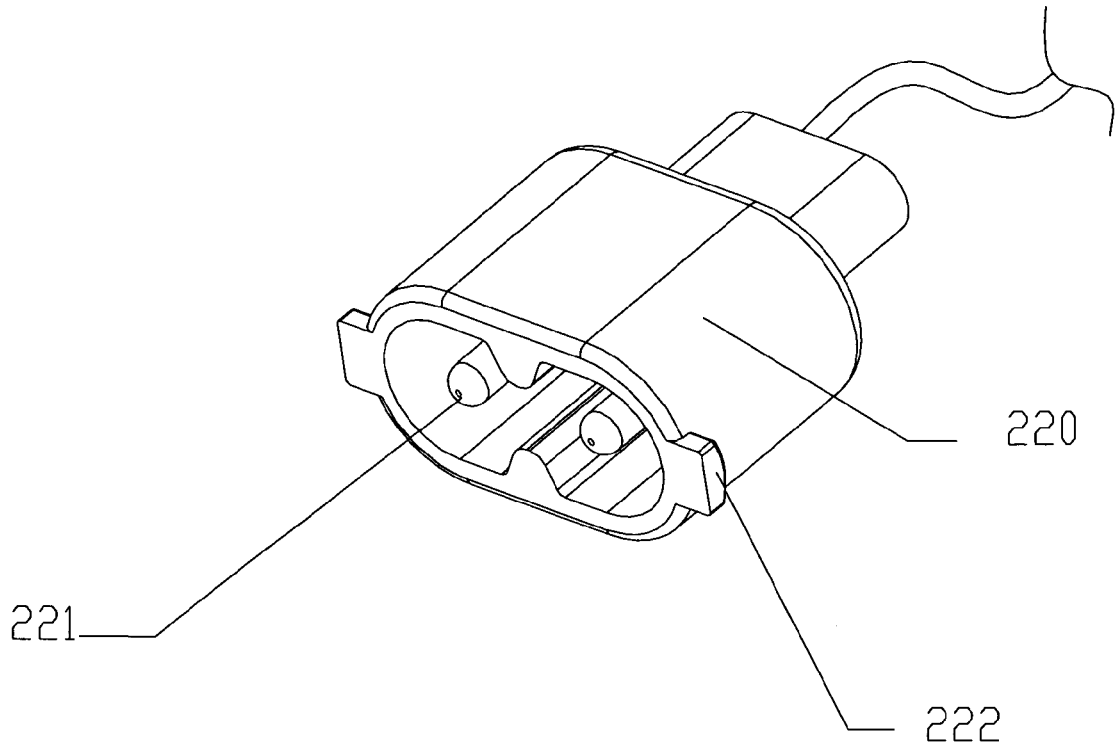
FIG. 5 is a structural drawing of the female plug of the safe power plugging mechanism.
Figure 6:
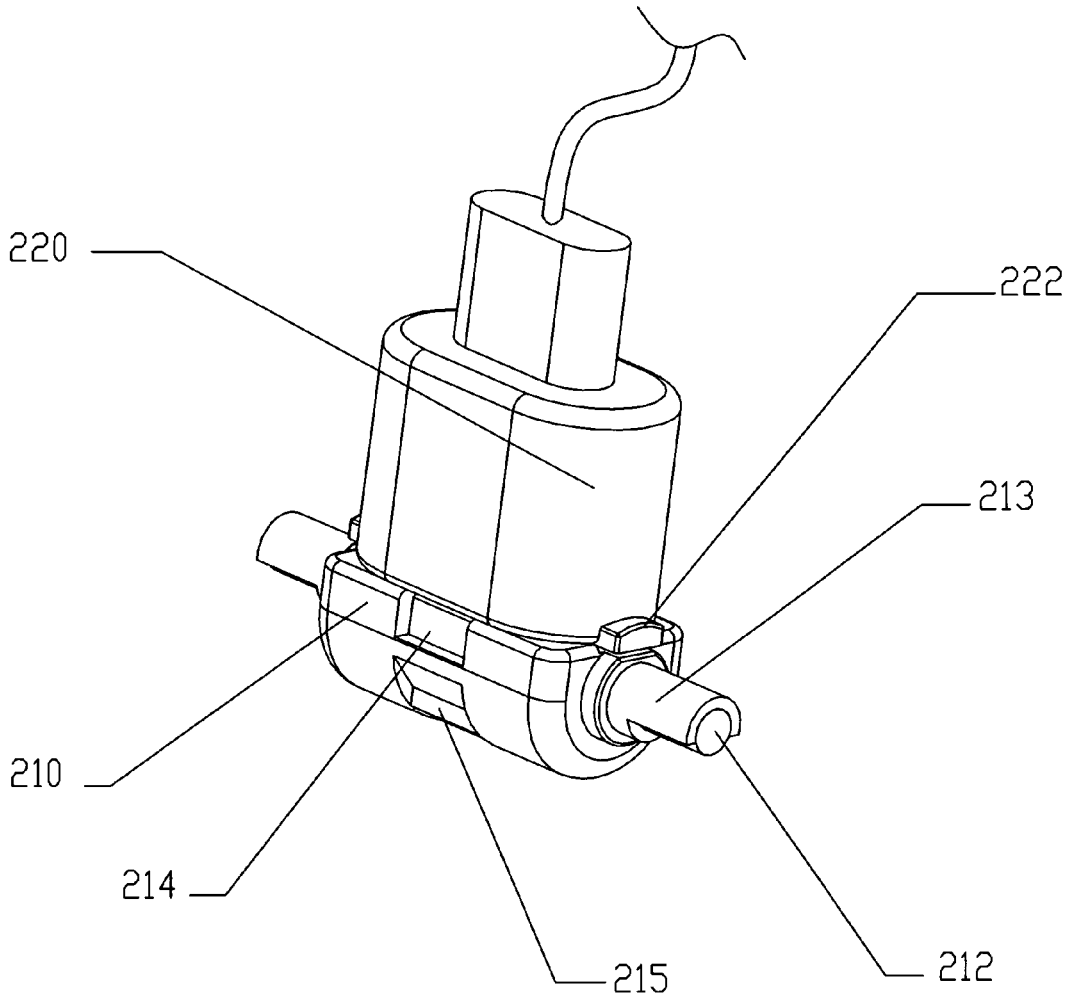
FIG. 6 is a drawing showing fitting between the male and female plugs of the safe power plugging mechanism.

The male plug 210 can be fitted with a female plug 220, as shown in FIG. 6. The enclosure of the female plug is made of insulating material, and is configured inside with notches fitting the plugging terminals of the male plug 210. Conducting poles 221 are configured inside the notches at a position corresponding to the conducting plates 211, as shown in FIG. 5.

The male plug 210 can be configured according to various existing standards of the prior-art mechanisms, such as a smart plug. New and independent plugging mechanism standards may also be applicable, such as designs of polygonal plugging terminals. Also, the power base 100 mentioned in the present invention is not restricted to one kind of mobile plug or socket board. It can also be configured on various existing power plugging mechanisms, such as wall-mounted sockets.

The male plug 210 can revolve around the pivot joint axis 212, as shown in FIG. 2*a* and FIG. 2*b*. The pivot joint axis 212 is made of electrically conducting metal material. Its inside is connected to the conducting plates 211 through conducting lines. When the conducting poles 221 of the female plug 220 are inserted, the pivot joint axis is electrically connected to the conducting plates 211 through the conducting poles 221. The rear side of the female plug 220 is connected to an electric appliance (such as a notebook computer) through a cable.

Figure 3A:
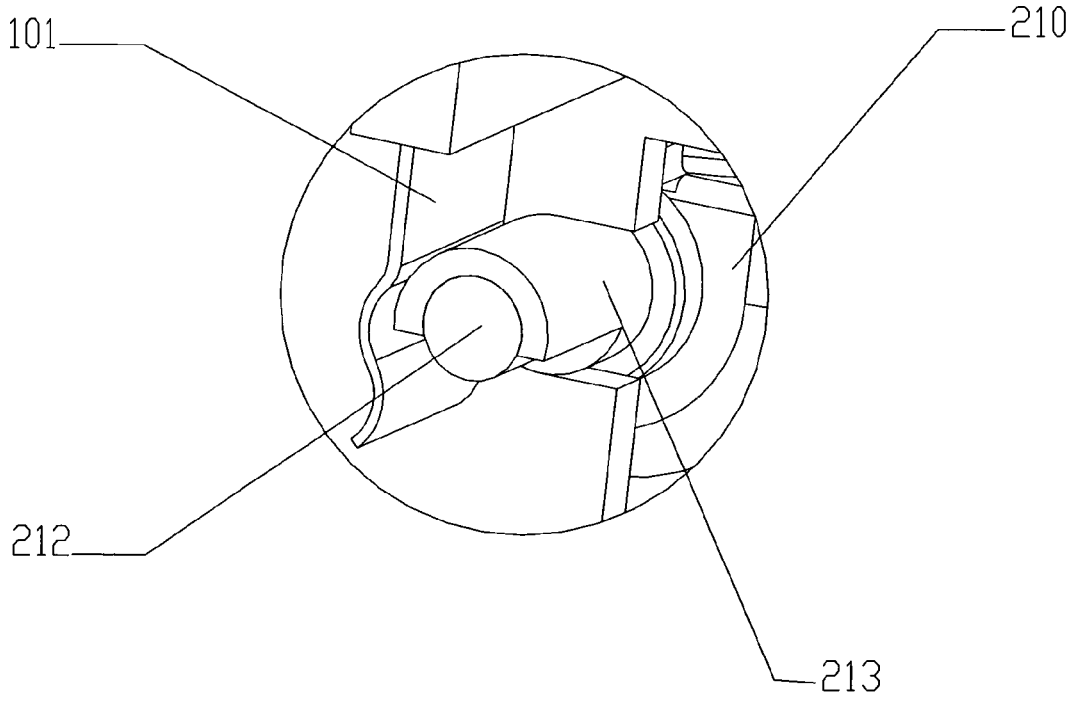
FIG. 3*a* is a partial drawing of the pivot joint axis of the safe power plugging mechanism as shown in FIG. 2*a;*
Figure 3B:
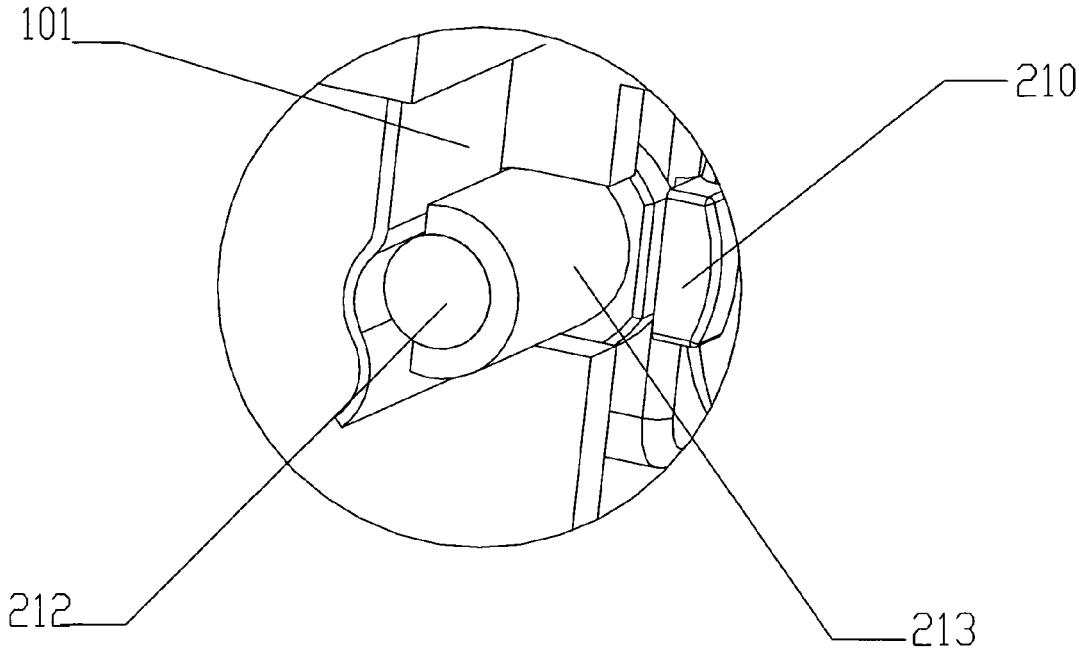
FIG. 3*b* is a partial drawing of the pivot joint axis of the safe power plugging mechanism as shown in FIG. 2*b;*

Outside of the pivot joint axis 212, there is a half-tile-shaped insulating tile 213, as shown in FIG. 3*a* and FIG. 3*b*. The insulating tile 213 is configured around part of the circumference of the pivot joint axis 212. When the female plug 220 connects the male plug 210 from a specific angle (vertical direction in the preferred embodiment), the insulating tile 213 is between the power connecting plate 101 and the pivot joint axis 212, as shown in FIG. 2*a* and FIG. 3*a*. At this time, in the male plug 210, all parts from the pivot joint axis 212 to the conducting plates 211 are without power and the female plug 220 can be pulled out or plugged in at will. As there is no power inside the male plug 210 at this time, there will be no accidental exposure of the conducting plates as may occur with prior-art mechanisms.

In the safe power plugging mechanism when the female plug 220 is plugged onto the male plug 210, and the male plug 210 is turned to the horizontal angle (the vertical or horizontal angle is designated for explanatory purposes and can be a specific angle), as the pivot joint axis 212 turns along with the insulating tile 213, the power connecting plate 101 with electric power contacts the pivot joint axis 212 and transmits electricity to the electric appliance connected by the female plug 220. For detailed turning situations, please refer to FIG. 2*a* and FIG. 2*b*, as well as the enlarged drawings FIG. 3*a* and FIG. 3*b*.

To increase safety, in a preferred embodiment of the safe power plugging mechanism, a concave locking part 214 is configured on the enclosure of the male plug 210, as shown in FIG. 7*a* to FIG. 7*d*. Meanwhile, a flexible raised locking part 112 is correspondingly configured on the rear side wall of the receptacle on the socket baseboard 120 parallel to the pivot joint axis 212. When the male plug 210 is at a vertical direction, i.e., the insulating tile 213 blocks electrical connection between the power connecting plate 101 and the pivot joint axis 212, the locking part locks the male plug 210 and maintains the conducting plates 211 at a disconnected state. It does not become unlocked unless the female plug 220 is inserted from the vertical direction and the outer side wall of the female plug 220 pushes back the raised locking part 112. The male plug 210 cannot be turned unless the female plug 220 is plugged onto the male plug 210. When the pivot joint axis 212 is turned from the state shown in FIG. 3*a* to the state shown in FIG. 3*b*, the insulating tile 213 is turned outside, and the pivot joint axis 212 contacts the power connecting plate 101, and electric power can be conducted.

Figure 8A:
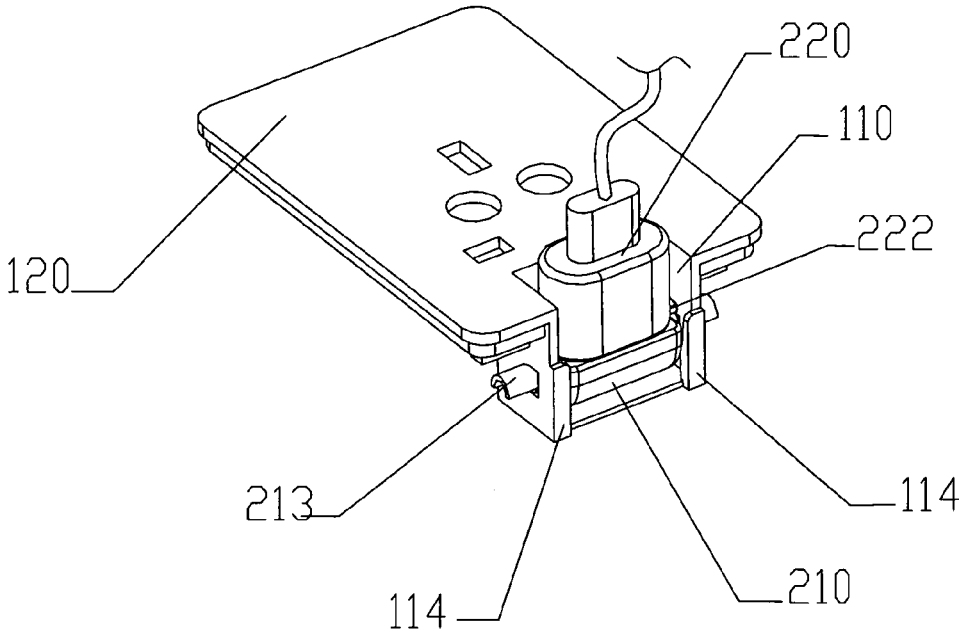
FIG. 8*a* and FIG. 8*b* show the inner structure of the safe power plugging mechanism when electrically connected.
Figure 8B:
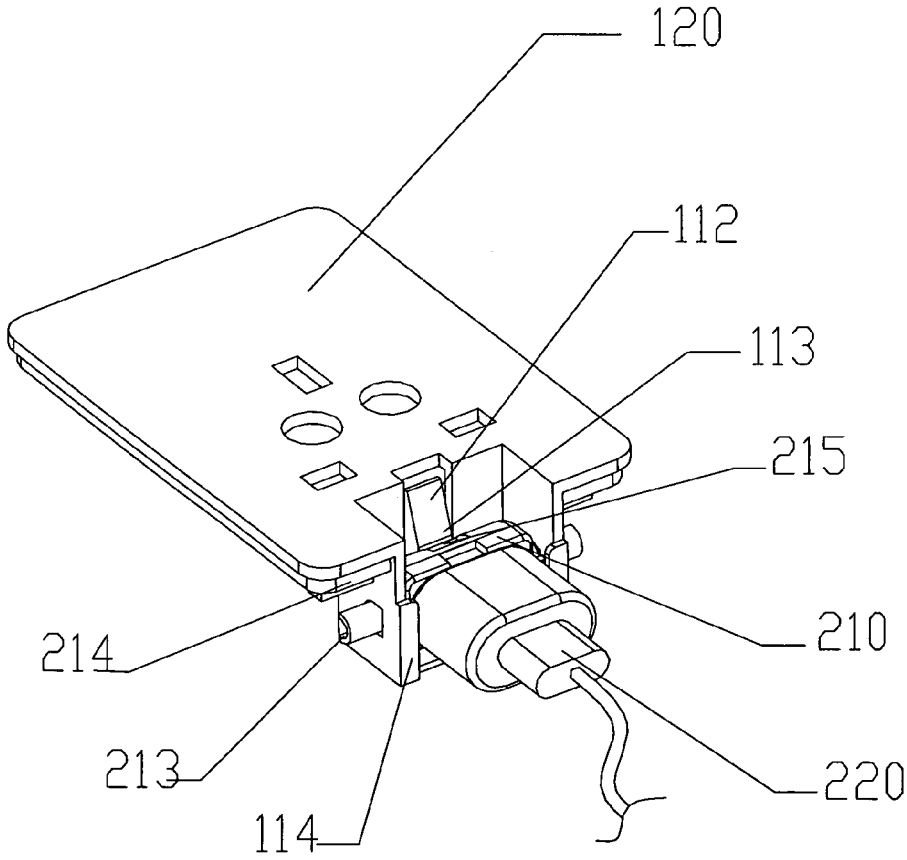

As an alternative, in another preferred embodiment, the front side of the receptacle 110 is configured with a blocking wall 114, as shown in FIG. 8*a* and FIG. 8*b*, and a blocking nose 222 is configured on the female plug 220, as shown in FIG. 5 and FIG. 6. When the female plug 220 is plugged onto the male plug 210 and the male plug 210 is turned until the power connecting plate 101 electrically connects the pivot joint axis 212, the blocking nose 222 of the female plug 220 is turned to the rear side of the blocking wall 114, avoiding accidental separation between the female plug 220 and the male plug 210 during the conducting state. In this way, during abnormal situations when the female plug 220 is separated from the male plug 220, the possibility of exposure of the live male plug 210 is reduced, and possible dangers are completely avoided. In particular, when operated by children or during misoperation, safety is guaranteed.

Figure 7A:
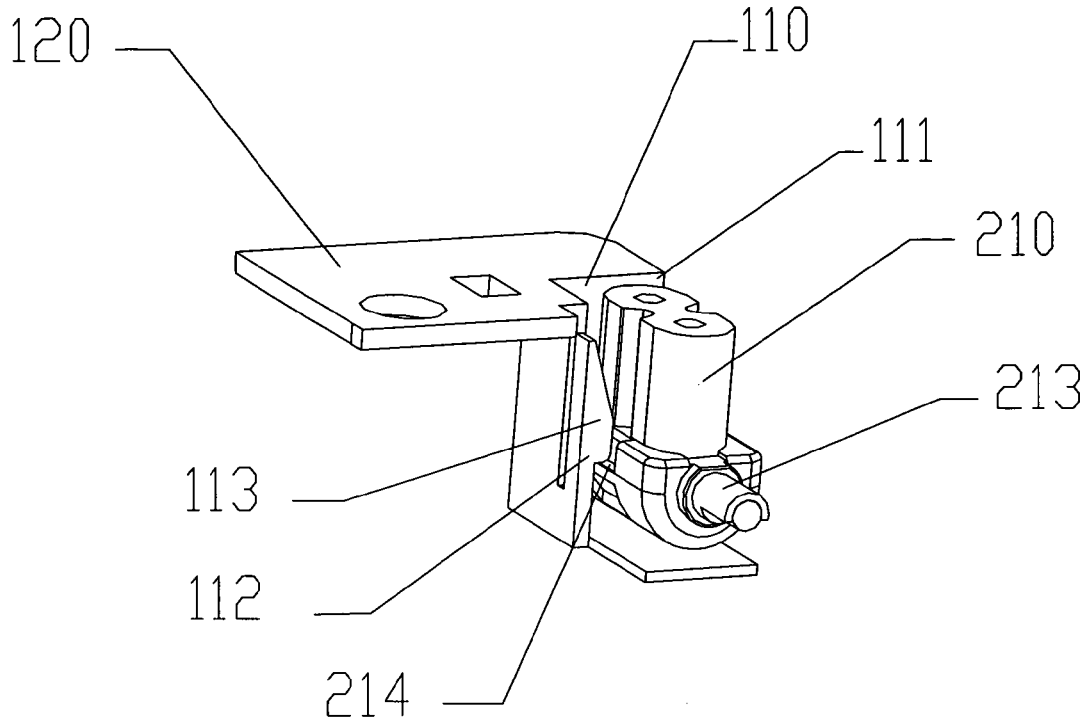
FIG. 7*a*-FIG. 7*d* are lateral sectional drawings of the safe power plugging mechanism at different plugging processes.
Figure 7B:
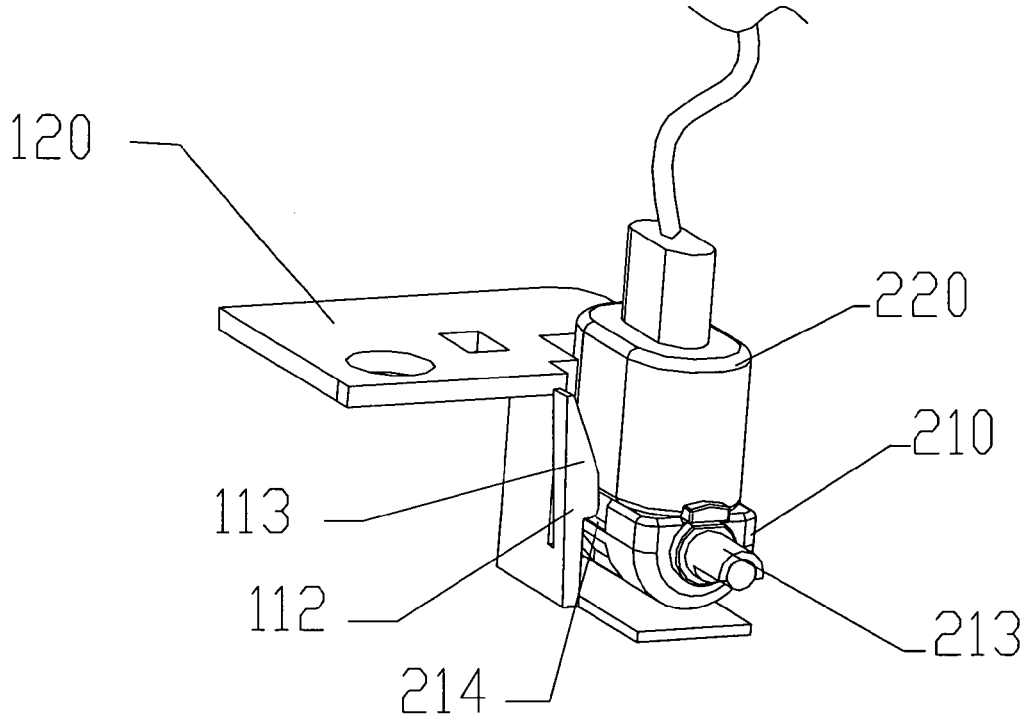
Figure 7C:
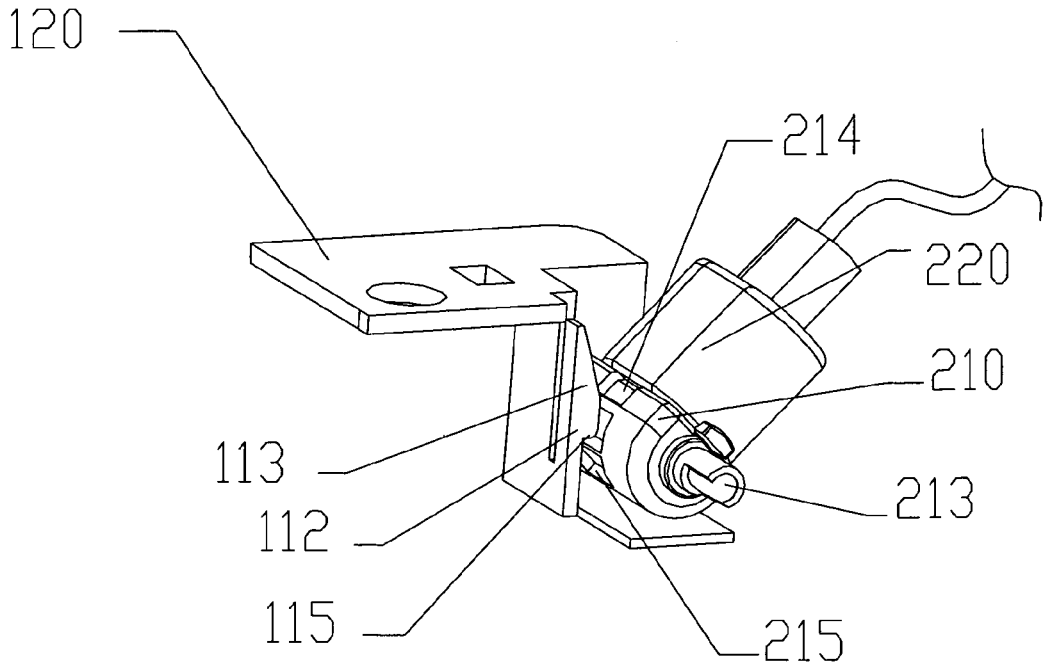
Figure 7D:
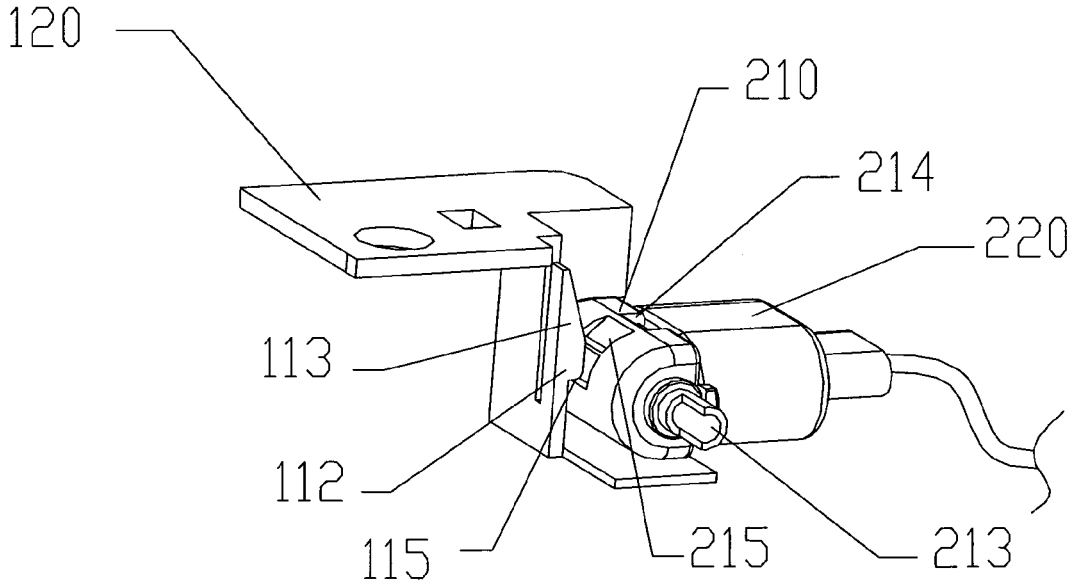

As another alternative, in a preferred embodiment of the safe power plugging mechanism, multiple sockets 215 can be configured on the male plug 210, as shown in FIG. 4, FIG. 7*c* and FIG. 7*d*. As they match the stage on the raised locking part 112, when the male plug is turned outside, a clear sound of "click" is produced, providing better quality feeling of the product during usage, and also serving as an indication of the turning angle for the operator.

In the safe power plugging mechanism, since the female plug 220 cannot be pulled off unless the male plug 210 is in a vertical direction in the receptacle 110, when the male plug 210 is not connected, the concave locking part 214 on it is locked by the raised locking part 112 and cannot be turned. Meanwhile, the pivot joint axis 212 is covered and separated by the insulating tile 213 from the power connecting plate 101, maintaining electric disconnection inside the male plug 210.

When the female plug 220 is plugged onto the male plug 210, its outside wall pushes back the raised locking part 112 through the protruding part 113 and unlocks the male plug 210. When the female plug 220 turns the male plug 210 to the horizontal direction, the insulating tile 213 loses its insulating function, and the pivot joint axis 212 contacts the power connecting plate 101. Meanwhile, the blocking nose 222 on the enclosure of the female plug 220 locks onto the blocking wall 114 at the front side of the receptacle 110, ensuring tight connection between the female plug 220 and the male plug 210 during the conducting state.

After usage, the female plug 220 shall turn the male plug 210 upward until its power is disconnected, and the blocking nose 222 is unlocked from the locking position behind the blocking wall 114. At this time, there is no electricity present inside the male plug 210, and the female plug 220 can be pulled off at will. Meanwhile, the male plug 210 is locked at a power disconnection state. Hence, the safe power plugging mechanism realizes safety assurance in its overall structure.

Although the invention has been explained in relation to its preferred embodiments, it is to be understood that many other possible modifications and variations can be made without departing from the spirit and the scope of the invention as hereinafter claimed.

The invention claimed is:

1. A safe power plugging mechanism comprising:

a power base with a pivot joint;

a male plug configured on the pivot joint of the power base;

an enclosure of the male plug being made of insulating material, and configured inside with conducting plates, which are electrically connected with a conductive pivot joint axis in the male plug; and a half-tile-shaped insulating tile outside the pivot joint axis, which is integral with the enclosure of the male plug, and which partially encloses the pivot joint axis;

a power connection plate configured inside the power base to connect with an external power source so that when the male plug is turned to a specific angle, the power connection plate contacts the pivot joint axis, and electrically connects the conducting plates of the male plug; and a female plug having an enclosure which is made of insulating material and is configured with two conducting poles which at an inside fit the conducting plates of the male plug.

2. The safe plugging mechanism as claimed in claim 1, wherein a receptacle is configured on the power base to house the male plug; two sides of the receptacle being configured as supporting walls to fit the pivot joint axis; a side wall of the receptacle parallel to the pivot joint axis being configured with a raised locking part; and at a corresponding position on the enclosure of the male plug, a concave locking part is configured to fit the raised locking part and lock the male plug at a specific position, so that the insulating tile is maintained between the power connecting plate and the pivot joint axis when the female plug is not connected with the male plug.

3. The safe plugging mechanism as claimed in claim 2, wherein the raised locking part is configured on the side wall of the receptacle in a flexible manner and is configured with a protruding part so that when the female plug is inserted, the enclosure of the female plug unlocks the fitting between the raised locking part and the concave locking part.

4. The safe plugging mechanism as claimed in claim 3, wherein the two side walls of the receptacle are configured with blocking walls on front extensions, and at the corresponding position on the enclosure of the female plug, a blocking nose is configured, so as to maintain electrical connection between the female plug and the male plug when the power connecting plate contacts the pivot joint axis.

5. The safe plugging mechanism as claimed in claim 4, wherein a lower side of the protruding part is configured as a stage, and on the lower side of the concave locking part, at least two sockets are configured to fit the stage with a click when turning the male plug.

6. The safe plugging mechanism as claimed in claim 1, wherein the male plug and the female plug are of smart-plug structures.

7. The safe plugging mechanism as claimed in claim 6, wherein a receptacle is configured on a socket baseboard.

8. The safe plugging mechanism as claimed in claim 2, wherein the male plug and the female plug are of smart-plug structures.

9. The safe plugging mechanism as claimed in claim 3, wherein the male plug and the female plug are of smart-plug structures.

10. The safe plugging mechanism as claimed in claim 4, wherein the male plug and the female plug are of smart-plug structures.

11. The safe plugging mechanism as claimed in claim 5, wherein the male plug and the female plug are of smart-plug structures.

* * * * *